US005389436A

United States Patent [19]

Totsuka et al.

[11] Patent Number: 5,389,436

[45] Date of Patent: Feb. 14, 1995

[54] SURFACE-TREATED METAL SHEET WHICH EXCELS IN WORKABILITY, ELECTRICAL CONDUCTIVITY AND CORROSION RESISTANCE, AND METHOD OF PRODUCING THE SAME

[75] Inventors: Nobuo Totsuka; Masaki Mabuchi; Katsuhei Kikuchi; Yoshihiro Naruse, all of Chiba, Japan

[73] Assignee: Kawasaki Steel Corporation, Japan

[21] Appl. No.: 160,051

[22] Filed: Nov. 30, 1993

[30] Foreign Application Priority Data

Nov. 30, 1992 [JP] Japan ..... 4-320146

[51] Int. Cl.[6] ..... B32B 9/00

[52] U.S. Cl. ..... 428/327; 428/323; 427/202; 427/376.8; 427/405; 427/436

[58] Field of Search ..... 427/202, 376.8, 405, 427/436; 428/327, 323

[56] References Cited

U.S. PATENT DOCUMENTS

| | | | |
|---|---|---|---|
| 3,591,350 | 7/1971 | Stareck et al. | 427/405 |
| 3,706,124 | 12/1972 | Leontaritis et al. | 427/405 |
| 4,003,760 | 1/1977 | Labenski et al. | 427/409 |
| 4,363,846 | 12/1982 | Kaneki | 428/209 |
| 4,469,749 | 9/1984 | Schwarz | 427/202 |
| 4,487,815 | 12/1984 | Dorsett et al. | 427/405 |
| 4,555,445 | 11/1985 | Frey et al. | 427/405 |
| 4,614,691 | 9/1986 | Inui et al. | 427/405 |
| 5,061,550 | 10/1991 | Shimizu et al. | 428/209 |

*Primary Examiner*—Patrick J. Ryan
*Assistant Examiner*—Kam F. Lee
*Attorney, Agent, or Firm*—Austin R. Miller

[57] ABSTRACT

A surface-treated metal sheet which excels in workability, electrical conductivity and corrosion resistance has a metal sheet which has been plated as required, a chromate layer as a first layer formed on at least one side of the metal sheet, with a deposition amount of about 5 to 200 mg/m$^2$ as calculated on the basis of Cr, and a second layer formed on the first layer from organic lubricant particles, with a deposition amount of from about 5 to 1000 mg/m$^2$, such that the area coated by the organic lubricant particles to the entire area of the metal sheet surface is below about 50%. The second layer is preferably applied with a roll coater, a spin coater or a dip coater, a dispersion liquid or an emulsion containing about 0.1 to 40 wt. % of the organic lubricant particles so as to provide a wet film thickness of about 0.2 to 10 μm.

6 Claims, 2 Drawing Sheets

SURFACE-TREATED METAL SHEET WHICH EXCELS IN WORKABILITY, ELECTRICAL CONDUCTIVITY AND CORROSION RESISTANCE, AND METHOD OF PRODUCING THE SAME

BACKGROUND OF THE INVENTION

1. Field of the Invention

The present invention relates to a surface-treated metal sheet which excels in press-workability, electrical conductivity and corrosion resistance and which is used mainly as a component of household electric appliances, office automation equipment, automobiles and so forth. The invention also is concerned with a method of producing such a metal sheet.

2. Description of the Related Art

Production of household electric appliances, office automation equipment, automobiles and so forth employ press-forming work on various kinds of metal sheets such as non-plated steel sheets, galvanized or galvanealed steel sheets, aluminum (Al) or Al-alloy sheet, for example.

Conventionally, press-forming work has encountered serious problems due to the use of a lubricating oil which is applied to the metal sheet for reducing sliding resistance of the sheet material.

In general, application of lubricating oil is effected by spraying, so that the working environment tends to be adversely affected due to scattering of the lubricating oil.

Degreasing treatment is necessary after press-forming, in order to remove the lubricating oil. The degreasing treatment usually employs a solvent such as 1—1—1 trichloroethane or an alkali detergent. The use of such solvent not only degrades the working environment but also requires a suitable anti-pollution countermeasure which raises the production cost and itself degrades the working environment.

Under these circumstances techniques have been developed to eliminate the necessity of lubricant, as well as degreasing, as disclosed, for example, in Japanese Patent Laid-Open Nos. 60-103185 and 62-73938. These techniques employ so-called self-lubricating steel sheet having a lubricant-containing resin layer containing a variety of lubricants and formed on a chromate layer which overlies a plated steel sheet.

These techniques, however, suffer from a critical problem in that the electrical conductivity inherently possessed by the metal sheet is impaired due to the presence of the resin layer.

More specifically, the resin which generally has a very high volumetric specific resistivity of $10^{15}$ Ω.cm or so produces an inter-layer resistance of $10^{10}$Ω or greater on the metal sheet surface even when it is applied as a very thin film of 1 μm or so. Such high electrical resistance seriously impairs the electrical conductivity and grounding characteristics of the product.

In view of this problem, Japanese Patent Laid-Open No. 63-83172 proposed a technique in which conductive particles are dispersed in the resin layer so as to improve electrical conductivity.

According to this technique, however, the electrical conductivity does not recover enough electrical conductivity and grounding characteristics.

For instance, metal sheets for a computer chassis are required to have a high shielding effect against electromagnetic waves, in order to prevent leakage of high-frequency electromagnetic waves to the exterior, as well as generation of noise due to electromagnetic induction. In order to meet this requirement the metal sheet used for such a purpose must have a surface electrical resistivity of 1 Ω or less.

In order that a sufficiently high level of electrical conductivity is obtained through the technique shown in Japanese Patent Laid-Open No. 63-83172, it is necessary to disperse a large quantity of conductive particles. This not only impedes the work of applying the resin but also impairs the characteristics inherently possessed by the resin. In addition, the high content of the conductive particles in the resin layer tends to impair the corrosion resistance due to galvanic corrosion (corrosion due to contact between metals having different levels of ionization potential) due to enhanced contact between the conductive particles and the underlying metal.

Japanese Patent Laid-Open No. 63-114635 discloses a conductive surface-treated steel sheet having a discontinuous film formed by a resin dispersed on a chromate film.

This steel sheet is disadvantageous in that coating with fine particles cannot easily be conducted with the use of a resin emulsion in electrostatic dispersion coating and in that the particle size of the resin tends to increase after coating due to polymerization of the resin material such as an acrylic emulsion used in the coating process. The increase in the size of the resin particles serving as lubricant undesirably reduces the chance of electrical contact between the metal sheet coated with the lubricant particles and another metal which has to be kept in electrical contact with the coated sheet, thus impairing coating characteristics.

Increase of the lubricant particle size also enhances the tendency of the particles to come off during handling, thus deteriorating workability.

In addition, no specific consideration for improving press workability is given in the art disclosed in Japanese patent Laid-Open No. 63-114635.

SUMMARY OF THE INVENTION

Accordingly, an object of the present invention is to provide a surface-treated metal sheet which has excellent conductivity and grounding characteristics and which can easily be press-worked without application of lubricant, thereby overcoming the problems of the known art.

As a result of an intense study, the present inventors have discovered that the provision of a resin layer is not essential for the improvement of workability; high workability can be obtained when predetermined amounts of lubricating particles are fixed on the surface of the metal sheet. In order to preserve sufficient electrical conductivity at the metal sheet surface, the coated area ratio of the lubricating layer must be less than about 50%.

To this end, according to the present invention, there is provided a surface-treated metal sheet which excels in workability, electrical conductivity and corrosion resistance, comprising: a metal sheet which has been plated as required; a chromate layer as a first layer formed on at least one side of the metal sheet, in an amount of about 5 to 200 mg/m$^2$ calculated on the basis of Cr, and a second layer formed on the first layer from organic lubricant particles, with a deposition amount of from about 5 to 1000 mg/m$^2$, such that the area coated by the organic lubricant particles to the entire area of the metal sheet surface is less than about 50%.

The invention also provides a method of producing a surface-treated metal sheet as specified above.

In the surface-treated metal sheet, as well as the sheet production method, the organic lubricant particles preferably contain particles of one, two or more entities selected from the group consisting of paraffin wax, polyolefin wax, denatured polyolefin wax, polyolefin halide wax and a fluororesin.

The above and other objects, features and advantages of the present invention will become clear from the following description in the specification and the appended claims.

DETAILED DESCRIPTION OF THE INVENTION

A metal sheet or plated metal sheet in accordance with the present invention broadly includes a variety of metal sheets such as steel sheets, galvanized or galvanealed steel sheets, steel sheets plated with Al or Al alloy, aluminum or aluminum alloy sheets, and so forth, intended to be press-worked into panels or other structural components of various products such as household electric appliances, office automation equipment, automobiles and so forth.

The chromate layer, which is formed as a primary layer on the surface of the metal sheet or plated metal sheet of the present invention is intended to provide resistance to corrosion under comparatively gentle corrosive conditions such as indoor use or use free of exposure to rain. The chromate layer may be selected from various types, including any reaction-type chromate layer, electrolytic chromate layer or application chromate layer, and can be freely selected according to the type of production equipment or production line employed in the factory for forming the underlying metal or for providing surface treatment.

A Cr deposition amount less than about 5 $mg/m^2$ is insufficient to attain the required resistance to corrosion, while deposition of Cr in excess of about 200 $mg/m^2$uneconomically causes saturation of corrosion prevention effect. Such a large amount of Cr deposition tends to cause exfoliation of the coating layer due to breakage of the chromate layer when the coating is applied subsequently to the press work. The amount of deposition of Cr therefore is limited to range between about 5 and 200 $mg/m^2$ on a basis of the metal Cr.

Figure 1:
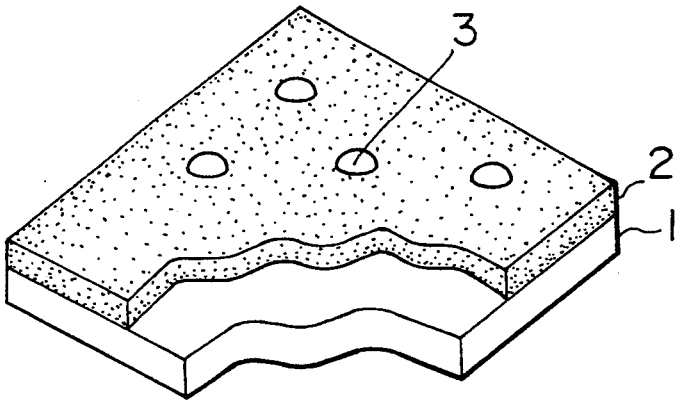
FIG. 1 is a schematic perspective view of a metal sheet comprising one embodiment of the present invention.

According to one embodiment of the present invention, a chromate layer 2 (FIG. 1) is formed as the first layer on metal sheet 1. Then a second layer composed of organic lubricant particles 3 is formed on the chromate layer 2.

The term "organic lubricant particles" is used in this specification to mean precipated or granular material of organic matter which exhibits an appreciable lubrication effect when the metal sheet of the invention is subjected to work such as press work.

In order to obtain sufficiently high workability of the surface-treated metal sheet of the present invention, the organic lubricant particle layer is preferably formed from one, two or more kinds of lubricants selected from the group consisting of paraffin wax, polyolefin wax, denatured polyolefin wax, polyolefin halide wax and fluororesin.

The application of the organic lubricant particles 3 onto the chromate layer 2 may be effected by means of a roll coater, spin coater or dip coater.

Deposition of the organic lubricant particles below about 5 $mg/m^2$ does not provide significant lubricating effect, whereas deposition of organic lubricant particles in excess of about 1000 $mg/m^2$ reduces electrical conductivity and impairs the grounding characteristics and electromagnetic shielding effect of the sheet to unacceptable levels. The amount of deposition of the organic lubricant particles, therefore, is determined to range from about 5 $mg/m^2$ to 1000 $g/m^2$.

Accordingly, the preferable amount of deposition of the organic lubricant particles ranges from about 10 to less than 100 $mg/m^2$.

Figure 2:
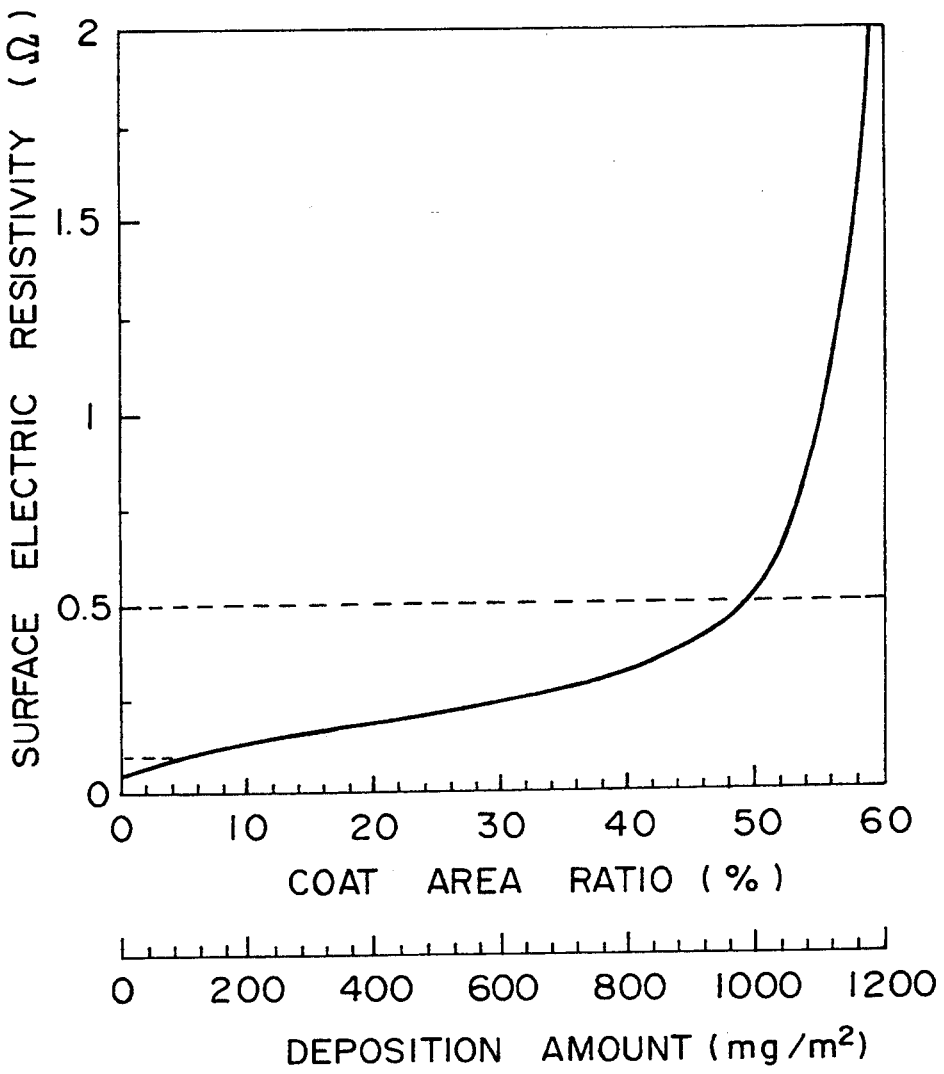
FIG. 2 is a graph illustrating how the surface resistivity (Ω) of a metal sheet varies according to coating area ratio (%) and the amount of deposition ($mg/m^2$) in accordance with features of this invention.

It will also be seen from FIG. 2 of the drawings and Table 1 that the required level of conductivity cannot be obtained when the ratio of the area coated by the organic lubricant particles to the entire steel sheet surface area is about 50% or greater. The ratio of the coated area therefore is determined to be less than about 50%.

The coated area ratio mentioned above can be measured by microscopic examination method for determining non-metallic inclusions in steel, as specified by JIS (Japanese Industrial Standards) G0555.

A mean particle size of the organic lubricant particles exceeding about 20 μm increases the tendency for the particles to come off the metal sheet during handling prior to press work, and also reduces the metal-to-metal contact between the surface-treated metal sheet of the invention and any other metal member, thus impairing grounding characteristics.

In order to obtain excellent workability and grounding characteristics, therefore, the mean particle size of the organic lubricant particles is restricted to a value up to about 20 μm but not greater.

Affinity or adhesion between the metal and any paint coating layer provided on the layer of the organic lubricant particles is enhanced when the surface of the organic lubricant particle layer is denatured with maleic acid or oxidized. This advantageous effect owes to formation of chemical bonding between the metal atoms and end functional groups formed as a result of the maleic-acid-denaturation or oxidation.

In order further to improve conductivity, i.e., grounding characteristics, it is preferred that the chromate layer contains silica. This is because the silica contained in the chromate layer reduces the ratio of area coated by the organic lubricant particles while preserving corrosion resistance.

The corrosion resistance of the sheet mainly depends on the presence of chromate because the ratio of the area coated by the organic lubricant particles is less than about 50%. When a specifically high corrosion resistance is required, the chromate may contain silica by an amount ranging from about 0.1 to 6.0 in terms of the weight ratio $SiO_2/Cr$. When the weight ratio $SiO_2/Cr$ is below about 0.1, the corrosion resistance is not high, whereas the weight ratio $SiO_2/Cr$ exceeding about 6.0 causes reduction of electrical conductivity. For these reasons, the weight ratio $SiO_2/Cr$ is determined to range from about 0.1 to 6.0.

According to the present invention, surface treatment is effected on at least one side of the metal sheet. Surface treatment effected on only one side of the metal sheet suffices in, for example, simple press working in which only the metal sheet surface facing the punch is restrained so that sliding movement takes place only between the die and the surface of the metal sheet facing the die. When superior sliding characteristics are required on both sides of the metal sheet, both these surfaces may be subjected to the surface treatment of the present invention.

Preferably, the surface-treated metal sheet in accordance with the present invention is produced by forming, at least on one side of the metal sheet or plated metal sheet, a chromate layer in a deposition amount of about 5 to 200 mg/m$^2$ as calculated on the basis of Cr, and applying, on the surface of the chromate layer, a dispersion liquid or emulsion having an organic lubricant particle concentration of about 0.1 to 40 wt. % so as to form a wet film of about 0.2 to 10 μm thick as the second layer, such that the ratio of the area coated by the organic lubricant particles to the total metal sheet surface area is less than about 50%.

When the concentration of the organic lubricant particles in the dispersion or emulsion is below about 0.1 wt. %, the desired amount deposited cannot be obtained unless the wet film thickness, i.e., the thickness of the film formed by application of the dispersion liquid or emulsion containing organic lubricant particles as measured immediately after the application, is increased to an excessively large value. Such a large thickness makes it difficult to control the film thickness to attain uniform thickness distribution over the metal sheet surface. Conversely, an organic lubricant particle concentration exceeding about 40 wt. % enhances the viscosity of the liquid so as to cause a variation or uneven thickness distribution of the wet film.

Any wet film thickness below about 0.2 μm undesirably allows the applicator roll to contact the metal sheet directly, tending to cause exfoliation of the chromate layer to impair corrosion resistance. Conversely, control of the wet film thickness to develop a uniform thickness distribution is difficult to conduct when the wet film thickness exceeds about 10 μm.

EXAMPLES

The surface-treated metal sheet of the present invention will be more fully described through illustration by Examples.

The following steel sheet, plated steel sheets and aluminum alloy sheets were used as the base metal sheets in the production of products in these Examples. A steel equivalent to SPCC of JIS G 3141 was used as the steel of the sheets A to D shown below. The following sheets were used:

A. Cold-rolled steel sheet: Sheet thickness 1 mm

B. Electro galvanized steel sheet: Sheet thickness 1 mm; amount of plating zinc deposition 20 g/m$^2$ C. Steel sheet electroplated with zinc and nickel: Sheet thickness 1 mm, amount of deposition of plating zinc-nickel 20 g/m$^2$, nickel content 12%

D. Steel sheet dip-plated with 5% aluminum-zinc: Sheet thickness 1 mm, amount of deposition of plating composition 60 g/m$^2$ E. JIS A5182 aluminum alloy sheet: Sheet thickness 1 mm Each of the metal sheets mentioned above was vapor-degreased with 1—1—1-trichloroethane, and a chromate layer was formed through application of the chromate with a spin coater, followed by dehydration and baking. Then a solution was formed by dissolving a wax selected from those shown in Table 1, and was applied to the metal sheet by means of a spin coater, followed by dehydration at 120 ° C., whereby each test piece was obtained.

The amount of deposition of the chromate was determined by measuring the amount of elemental Cr through fluorescent X-ray analysis. The amount of deposition of the wax also was determined by measuring the C element through fluorescent X-ray analysis. The coated area ratio, i.e., the ratio of the area coated by the wax to the metal sheet surface area, was determined as a mean of the values obtained on arbitrary 20 fields of SEM observation (magnification 1000).

Workability was evaluated in terms of the value of the limiting draw ratio through a cupping test conducted by using a punch of 33 mm diameter without the use of oil.

The criteria of the evaluations are as shown below.

(1) For steel sheet and plated steel sheets

@:Limiting draw ratio (LDR) 2.30 or greater o:LDR not less than 2.24 but below 2.30

Δ:LDR not less than 2.12 but below 2.24 x:LDR below 2.12 (2) For aluminum alloy sheet

@:Limiting drawing ratio (LDR) not less than 2.12 o:LDR not less than 1.96 but below 2.12

Δ:LDR not less than 1.90 but below 1.96 x:LDR less than 1.90

Electrical conductivity was determined by measuring the surface resistivity by using a surface resistance meter LORESTA MCP-tester (commercial name) produced by Mitsubishi Petrochemical Engineering Co., and was evaluated on the basis of the mean value over 10 (ten) measurements, applying the following criteria.

@:below 0.1 Ω o:not less than 0.1 Ω but below 0.5 Ω

Δ:not less than 0.5 Ωbut below 2 Ω x:not less than 2 Ω

Corrosion resistance was evaluated on the following criteria, after keeping each test piece in a thermo/-humidistat oven maintaining an atmosphere of 50° C. and RH not less than 98%.

@:Generation of 5% white rust does not start before 48 hours in salt spray test specified by JIS 2371 o: No discoloration or spot rust x: Discoloration or spot rust occurred

Five types of waxes and two types of chromates shown below were used in the Examples. It is to be understood, however, that these waxes and chromates are only illustrative and other waxes and chromates may be used in the present invention.

WAXES a:SN Wax 22DS-F polyethylene wax Produced by SAN NOPCO Ltd.

b: SL 506 carnauba wax Produced by SAN NOPCO Ltd.

c: SL 630 containing polyolefin halide wax Produced by SAN NOPCO Ltd.

d: PARANOC 203 paraffin-base wax Produced by Nippon Oil Co., Ltd.

e: PERMARIN KUE-150 polyethylene oxide wax Produced by Sanyo Petrochemicals Co.,Ltd.

CHROMATES:

f: 4513 H (free of silica) Produced by Nippon Parkerizing Co., Ltd.

g: COSMER Produced by Kansai Paint Company Limited

Table 1 shows the conditions of surface treatments, together with the results of the evaluation. From this Table 1, it will be seen that all the examples of the surface-treated metal sheet of the present invention excelled in workability, electrical conductivity and corrosion resistance. Comparison Examples C-1, E-1, N-1 and G-1 showed inferior workability and corrosion resistance, due to lack of the surface treatment. Comparison Examples C-2, E-2, N-2 and G-2 also were inferior in corrosion resistance, due to too small amount of deposition of chromate, while Comparison Examples C-3, E-3, N-3, G-3, A-1 and A-2 exhibited only a low level of workability due to shortage of the wax. Conversely, Comparison Examples, which have excessively large wax contents, exhibited inferior electrical conductivity.

As will be understood from the foregoing description, according to the present invention, it is possible remarkably to improve the workability of non-plated or plated steel sheets, aluminum sheets or like metal sheets, without impairing electrical conductivity (surface resistivity). The metal sheet in accordance with the present invention therefore can be subjected to press-forming work without greasing and degreasing, while ensuring high electrical conductivity.

The surface-treated metal sheet of the present invention, therefore, can be used for products requiring excellent grounding characteristic; this could never be met by conventional lubricant-clad metal sheets. This invention further simplifies the process in pressing operations and contributes to significant improvements in the working environments.

TABLE 1

| CLASS | No. | TEST MATERIALS | CONDITIONS OF SURFACE TREATMENT | | | | | | | EVALUATION OF TEST RESULTS | | |
|---|---|---|---|---|---|---|---|---|---|---|---|---|
| | | | TYPE OF CHROMATE | DEHYDRATION TEMPERATURE (°C.) | Cr DEPOSITION AMOUNT (mg/m²) | TYPE OF WAX | MEAN PARTICLE SIZE (μm) | AMOUNT OF WAX DEPOSITION (mg/m²) | COATED AREA RATIO (%) | WORK-ABILITY | ELECTRI-CAL CONDUC-TIVITY | CORRO-SION RESIST-ANCE |
| COMPARISON EXAMPLES | C-1 | COLD- ROLLED SHEET | — | — | — | — | — | — | — | x | ◎ | x |
| | C-2 | COLD- ROLLED SHEET | f | 150 | 3.1 | a | 12 | 230 | 8 | ◎ | ∘ | x |
| | C-3 | COLD- ROLLED SHEET | f | 150 | 18 | a | 12 | 3 | <1 | Δ | ◎ | ∘ |
| | C-4 | COLD- ROLLED SHEET | f | 150 | 35 | a | 12 | 1140 | 57 | ◎ | x | ∘ |
| | C-5 | COLD- ROLLED SHEET | g | 150 | 40 | d | 43 | 300 | <1 | Δ | ∘ | ◎ |
| EXAMPLES OF THIS INVENTION | C-6 | COLD- ROLLED SHEET | f | 150 | 42 | a | 12 | 8 | 2 | ∘ | ◎ | ∘ |
| | C-7 | COLD- ROLLED SHEET | f | 150 | 81 | a | 12 | 30 | 41 | ◎ | ◎ | ∘ |
| | C-8 | COLD- ROLLED SHEET | g | 150 | 160 | a | 12 | 920 | 6 | ◎ | ∘ | ◎ |
| | C-9 | COLD- ROLLED SHEET | g | 150 | 36 | b | 7 | 250 | 4 | ◎ | ∘ | ◎ |
| | C-10 | COLD- ROLLED SHEET | g | 150 | 41 | c | 1 | 120 | 11 | ◎ | ∘ | ◎ |
| | C-11 | COLD- ROLLED SHEET | g | 150 | 45 | e | 2 | 20 | 2 | ◎ | ◎ | ◎ |
| COMPARISON EXAMPLES | E-1 | ELECTRO GALVANIZED STEEL SHEET | — | — | — | — | — | — | — | x | ◎ | x |
| | E-2 | ELECTRO GALVANIZED STEEL SHEET | g | 130 | 2.4 | b | 7 | 150 | 4 | ◎ | ∘ | x |
| | E-3 | ELECTRO GALVANIZED STEEL SHEET | g | 130 | 35 | b | 7 | 4 | <1 | Δ | ◎ | ◎ |
| | E-4 | ELECTRO GALVANIZED STEEL SHEET | f | 130 | 36 | b | 7 | 1204 | 61 | ◎ | x | ∘ |
| | E-5 | ELECTRO GALVANIZED STEEL SHEET | f | 130 | 32 | d | 43 | 220 | 6 | Δ | ∘ | ∘ |
| EXAMPLES OF THE INVENTION | E-6 | ELECTRO GALVANIZED STEEL SHEET | f | 130 | 33 | b | 7 | 15 | 1 | ◎ | ◎ | ∘ |
| | E-7 | ELECTRO GALVANIZED STEEL SHEET | g | 130 | 31 | b | 7 | 25 | 1 | ◎ | ◎ | ◎ |
| | E-8 | ELECTRO GALVANIZED STEEL SHEET | g | 130 | 30 | c | 1 | 250 | 7 | ◎ | ∘ | ◎ |
| | E-9 | ELECTRO GALVANIZED STEEL SHEET | g | 130 | 32 | a | 12 | 60 | 3 | ◎ | ◎ | ◎ |
| | E-10 | ELECTRO GALVANIZED STEEL SHEET | g | 130 | 40 | e | 2 | 40 | 2 | ◎ | ◎ | ◎ |
| COMPARISON EXAMPLES | N-1 | STEEL SHEET ELECTRO-PLATED WITH Zn—Ni | — | — | — | — | — | — | — | x | ◎ | x |
| | N-2 | STEEL SHEET ELECTRO-PLATED WITH Zn—Ni | f | 160 | 3.5 | c | 1 | 50 | 3 | ◎ | ◎ | x |
| | N-3 | STEEL SHEET ELECTRO-PLATED WITH Zn—Ni | f | 160 | 45 | c | 1 | 3 | <1 | Δ | ◎ | ∘ |
| | N-4 | STEEL SHEET ELECTRO-PLATED WITH Zn—Ni | f | 160 | 43 | c | 1 | 1390 | 54 | ◎ | x | ∘ |
| | N-5 | STEEL SHEET ELECTRO-PLATED WITH Zn—Ni | g | 160 | 50 | d | 43 | 260 | 8 | Δ | ∘ | ◎ |
| EXAMPLES OF THE INVENTION | N-6 | STEEL SHEET ELECTRO-PLATED WITH Zn—Ni | f | 160 | 46 | c | 1 | 15 | 1 | ∘ | ◎ | ∘ |
| | N-7 | STEEL SHEET ELECTRO-PLATED WITH Zn—Ni | f | 160 | 55 | c | 1 | 150 | 5 | ◎ | ∘ | ∘ |
| | N-8 | STEEL SHEET ELECTRO-PLATED WITH Zn—Ni | g | 160 | 51 | a | 12 | 150 | 4 | ◎ | ∘ | ◎ |

TABLE 1-continued

| CLASS | No. | TEST MATERIALS | CONDITIONS OF SURFACE TREATMENT | | | | | | | EVALUATION OF TEST RESULTS | | |
|---|---|---|---|---|---|---|---|---|---|---|---|---|
| | | | TYPE OF CHROMATE | DEHYDRATION TEMPERATURE (°C.) | Cr DEPOSITION AMOUNT ($mg/m^2$) | TYPE OF WAX | MEAN PARTICLE SIZE (μm) | AMOUNT OF WAX DEPOSITION ($mg/m^2$) | COATED AREA RATIO (%) | WORK-ABILITY | ELECTRI-CAL CONDUC-TIVITY | CORRO-SION RESIST-ANCE |
| | N-9 | STEEL SHEET ELECTRO-PLATED WITH Zn—Ni | g | 160 | 52 | b | 7 | 95 | 3 | ◎ | ◎ | ◎ |
| | N-10 | STEEL SHEET ELECTRO-PLATED WITH Zn—Ni | g | 160 | 48 | e | 2 | 35 | 2 | ◎ | ◎ | ◎ |
| COMPARISON EXAMPLES | G-1 | STEEL SHEET DIP-PLATED WITH 5% Al—Zn | — | — | — | — | — | — | — | x | ◎ | x |
| | G-2 | STEEL SHEET DIP-PLATED WITH 5% Al—Zn | g | 150 | 2.1 | a | 12 | 60 | 3 | ◎ | ◎ | x |
| | G-3 | STEEL SHEET DIP-PLATED WITH 5% Al—Zn | g | 150 | 60 | a | 12 | 3 | <1 | Δ | ◎ | ◎ |
| | G-4 | STEEL SHEET DIP-PLATED WITH 5% Al—Zn | g | 150 | 62 | a | 12 | 1210 | 56 | ◎ | x | ◎ |
| | G-5 | STEEL SHEET DIP-PLATED WITH 5% Al—Zn | f | 150 | 60 | d | 43 | 200 | 6 | Δ | ○ | ○ |
| EXAMPLES OF THE INVENTION | G-6 | STEEL SHEET DIP-PLATED WITH 5% Al—Zn | g | 150 | 23 | a | 12 | 50 | 2 | ◎ | ◎ | ◎ |
| | G-7 | STEEL SHEET DIP-PLATED WITH 5% Al—Zn | g | 150 | 61 | b | 7 | 95 | 3 | ◎ | ◎ | ◎ |
| | G-8 | STEEL SHEET DIP-PLATED WITH 5% Al—Zn | f | 150 | 6.3 | c | 1 | 95 | 3 | ◎ | ◎ | ○ |
| | G-9 | STEEL SHEET DIP-PLATED WITH 5% Al—Zn | f | 150 | 48 | e | 2 | 18 | 1 | ◎ | ◎ | ○ |
| | G-10 | STEEL SHEET DIP-PLATED WITH 5% Al—Zn | f | 150 | 42 | e | 2 | 41 | 2 | ◎ | ◎ | ○ |
| COMPARISON EXAMPLES | A-1 | 5182 Al-Alloy SHEET | — | — | — | — | — | — | — | x | ◎ | x |
| | A-2 | 5182 Al-Alloy SHEET | g | 130 | 36 | b | 7 | 3 | <1 | Δ | ◎ | ◎ |
| | A-3 | 5182 Al-Alloy SHEET | g | 130 | 35 | b | 7 | 1130 | 56 | ◎ | x | ◎ |
| | A-4 | 5182 Al-Alloy SHEET | f | 120 | 33 | d | 43 | 240 | 5 | Δ | ○ | ○ |
| EXAMPLES OF THE INVENTION | A-5 | 5182 Al-Alloy SHEET | g | 130 | 35 | b | 7 | 10 | <1 | ○ | ◎ | ◎ |
| | A-6 | 5182 Al-Alloy SHEET | g | 130 | 32 | b | 7 | 50 | 2 | ◎ | ◎ | ◎ |
| | A-7 | 5182 Al-Alloy SHEET | f | 120 | 34 | c | 1 | 50 | 2 | ◎ | ◎ | ○ |
| | A-8 | 5182 Al-Alloy SHEET | f | 120 | 33 | a | 12 | 50 | 2 | ◎ | ◎ | ○ |
| | A-9 | 5182 Al-Alloy SHEET | f | 120 | 30 | e | 2 | 40 | 2 | ◎ | ◎ | ○ |

What is claimed is:

1. A surface-treated metal sheet which excels in workability, electrical conductivity and corrosion resistance, comprising:

a metal sheet which has been plated;

a chromate layer formed on at least one side of said metal sheet, with a deposition amount of about 5 to 200 $mg/m^2$ calculated on the basis of Cr;

and a second layer at a thickness of about 0.2 μm and about 10.0 μm, formed on said chromate layer, comprising organic lubricant particles having a deposition amount of from about 5 to 1000 $mg/m^2$, such that the area coated by said organic lubricant particles to the entire area of the metal sheet surface is below about 50%.

2. A surface-treated metal sheet which excels in workability, electrical conductivity and corrosion resistance according to claim 1, wherein said organic lubricant particles include particles of one or more kinds of materials selected from the group consisting of paraffin wax, polyolefin wax, denatured polyolefin wax, polyolefin halide wax and fluororesins.

3. A surface-treated metal sheet which excels in workability, electrical conductivity and corrosion resistance according to claim 1, wherein the amount of deposition of said organic lubricant particles ranges from about 10 to less than 100 $mg/m^2$.

4. A surface-treated metal sheet which excels in workability, electrical conductivity and corrosion resistance according to claim 1, wherein the mean particle size of the organic lubricant particles is about 20 μm but not greater.

5. A surface-treated metal sheet which excels in workability, electrical conductivity and corrosion resistance according to claim 1, wherein the surfaces of said organic lubricant particles have been maleic-acid denatured or oxidized.

6. A surface-treated metal sheet which excels in workability, electrical conductivity and corrosion resistance according to claim 1, wherein said chromate layer contains silica ($SiO_2$) by an amount which ranges from about 0.1–6.0 in terms of the weight ratio of $SiO_2/Cr$.

* * * * *